United States Patent [19]

Armstrong

[11] Patent Number: 4,875,672

[45] Date of Patent: Oct. 24, 1989

[54] SWING BOARD TOY

[76] Inventor: W. Ted Armstrong, P.O. Box 40962, San Francisco, Calif. 94140

[21] Appl. No.: 242,593

[22] Filed: Sep. 12, 1988

[51] Int. Cl.[4] ..... A63B 23/04; A63G 1/20

[52] U.S. Cl. ..... 272/33 R; 272/1 R; 272/56; 272/97; 272/146; 280/78; 280/205

[58] Field of Search ..... 272/1 R, 1 B, 33 R, 272/30, 35, 50, 51, 54–56, 57, 96, 97, 111, 114, 120, 146; 280/78, 205

[56] References Cited

U.S. PATENT DOCUMENTS

| | | | |
|---|---|---|---|
| 1,733,919 | 10/1929 | Stout | 272/1 R |
| 3,060,637 | 10/1962 | Fightmaster | 272/1 R |
| 4,228,999 | 10/1980 | Armstrong . | |
| 4,248,446 | 2/1981 | Armstrong . | |
| 4,275,881 | 6/1981 | Armstrong . | |
| 4,290,601 | 9/1981 | Mittelstaot | 272/33 R X |
| 4,304,400 | 12/1981 | Armstrong . | |

FOREIGN PATENT DOCUMENTS

| | | | |
|---|---|---|---|
| 562246 | 8/1958 | Canada | 272/56 |
| 669983 | 12/1938 | Fed. Rep. of Germany | 272/57 |

*Primary Examiner*—Richard E. Chilcot, Jr.
*Attorney, Agent, or Firm*—Bielen & Peterson

[57] ABSTRACT

A toy utilizing a platform having first and second sides. A post extends the platform from one side to another and connects to an arm linked to a wheel. The wheel bears on the underside of the platform. The user is supported on the top side of the platform and uses weight shifting techniques to swing the board from side to side.

4 Claims, 1 Drawing Sheet

SWING BOARD TOY

BACKGROUND OF THE INVENTION

The present invention relates to a novel toy.

Many amusement devices have been improvised which utilizes the manual dexterity of a person to operate the same. For example the common swing and seesaw employ this principle. U.S. Pat. Nos. 4,228,999, 4,248,446, 4,275,881, and 4,304,400 disclose amusement devices which require mechanical operation by the user.

A toy which is manually operated and safe to use would be an advance in the art of toys and games.

SUMMARY OF THE INVENTION

In accordance with the present invention a novel and useful manually operated toy is provided.

The toy of the present invention utilizes a platform having a first side and a second opposite side. The platform may be flat and include an enlarged portion on one end thereof.

A post may be formed to extend through the platform and be movable relative to the platform. Means would also be included to prevent the post from shifting appreciably in a direction relatively normal to the platform.

A turnable member such as a wheel would bear on the second end or underside of the platform and move thereupon. An arm or shaft would be linked to the turnable member and the post. The arm or shaft may be rotatable relative to the wheel or be rotatable relative to the post and be rigidly attached to the wheel.

Means for preventing or limiting the motion of the turnable member along the underside of the platform may also be provided. Such means may take the form of skirts which depend from the platform in a direction generally transverse to the movement of the wheel.

Means may also be included for supporting the user on the second side of the platform. Such means may take the form of foot holds and a tethered rope or cord having a handle grip spaced from the foothold.

It should be noted that the turnable member or wheel may be offset from the center portion of the platform such that the platform is supported on an edge permitting the wheel to rock an opposite edge of the platform above the ground surface.

It may be apparent that a novel and useful swing action toy has been described.

It is therefore an object of the present invention to provide a swing action toy which is simple and easy to manufacture.

It is another object of the present invention to provide a swing action toy which permits the user to operate the same by shifting his weight side to side in a swinging motion.

Another object of the present invention is to provide a swing action toy which is safe to operate and provides the user with a substantial degree of exercise.

A further object of the present invention is to provide a swing action toy which teaches the user agility and balance.

The invention possesses other objects and advantages which will become apparent as the specification continues.

Figure 1:
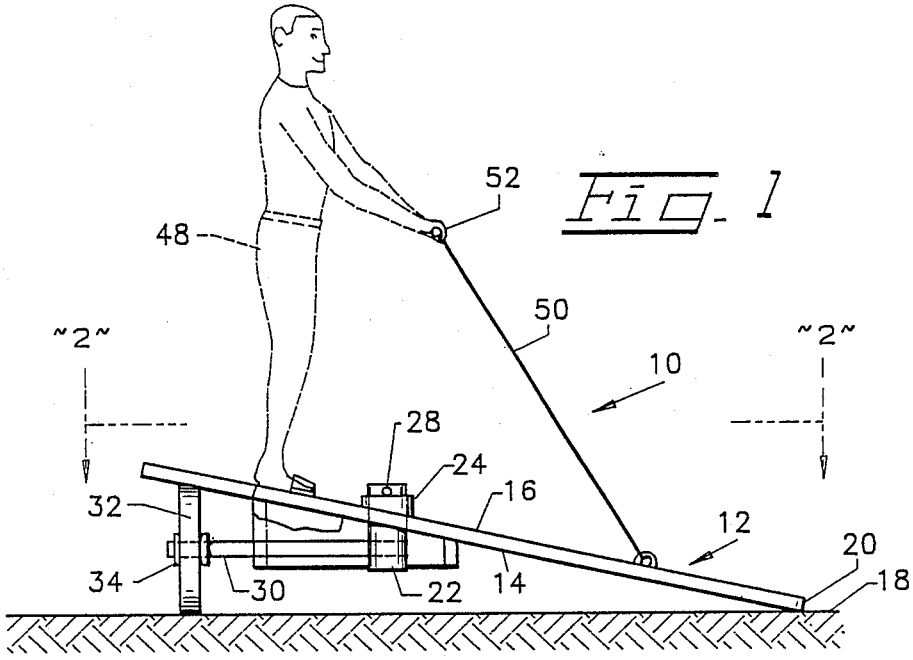
FIG. 1 is a side elevational view of the device of the present invention in operation.

For a better understanding of the invention reference is made to the following detailed description of the preferred embodiments thereof which should be referenced to the hereinabove described drawings.

DESCRIPTION OF THE PREFERRED EMBODIMENTS

Various aspects of the present invention will evolve from the following detailed description of the preferred embodiments which should be taken in conjunction with the hereinbefore described drawings.

The invention as a whole is depicted in the drawings by reference character 10. The swing action toy 10 includes as one of its elements a platform 12. Platform 12 includes a first side 14 and a second side 16. First or underside 14 of platform 12 contacts ground surface 18 at edge portion 20. A post 22 extends through platform 12 from first side 14 to second side 16. Enlargement 24 prevents post 22 from passing through platform 12 in conjunction with ears 26 and 28.

Connected to post 22 on first side 14 of platform 12 is a shaft or arm 30 which extends to rotatable member or wheel 32. Wheel 32 may rotate relative to shaft 30 via bearing 34. Alternatively, shaft 30 may be rigidly fixed to wheel 32 and rotate relative to post 22. Rotatable member 32 may be constructed of rubber or other flexible tire material and contact the undersurface 14 of platform 12, FIG. 1.

Figure 2:
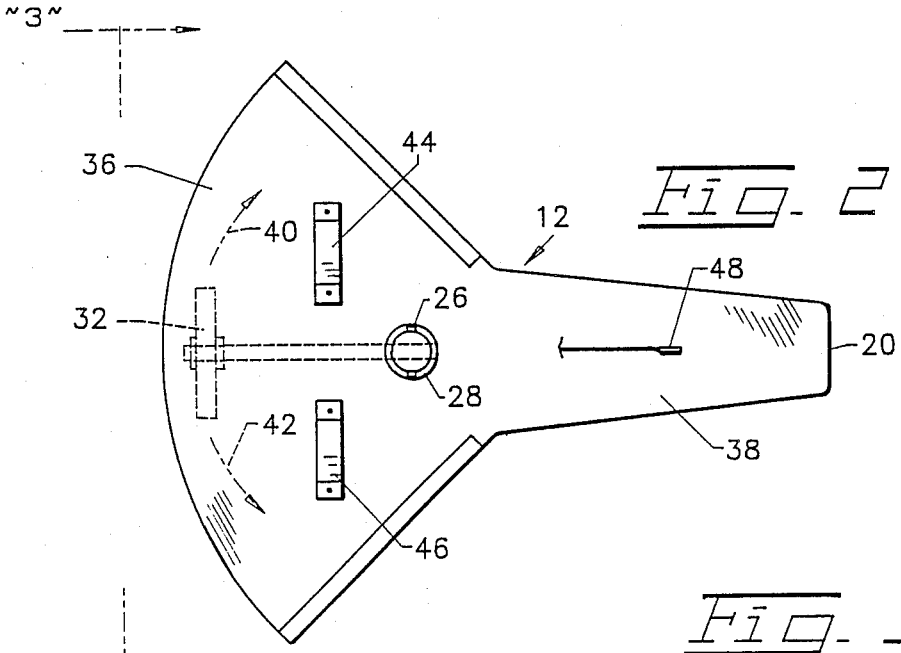
FIG. 2 is a sectional view or plan view of the device taken along 2—2 of FIG. 1.

With reference to FIG. 2, platform 12 may include an enlarged portion 36 which flares outwardly from base portion 38 thereof. Rotatable member 32 rides or bears on undersurface 14 at enlarged portion 36 of platform 12 as depicted by directional arrows 40 and 42.

Footholds 44 and 46 permit the user 48 to steady the lower portion of his torso. Ring member 48, attached firmly to platform 12, serves as a tie-down for rope or cord 50. The user 48 grips handle member 52 connected to rope 50.

Figure 3:
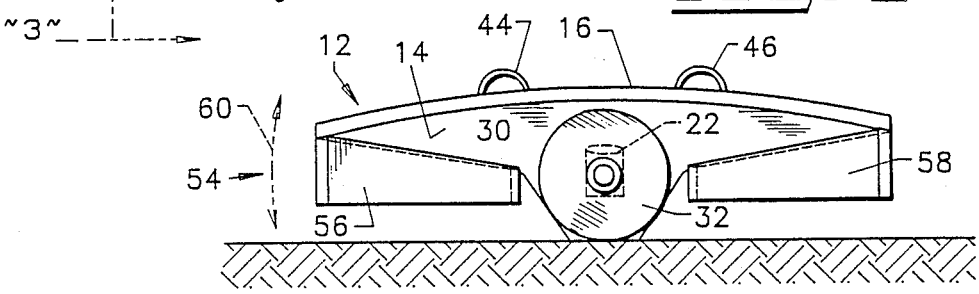
FIG. 3 is a rear elevational view taken along line 3—3 of FIG. 2.

Turning to FIG. 3 it may be observed that means 54 is also included for preventing motion or movement of wheel 32. Such means 54 may take the form of a pair of skirts 56 and 58. Thus, platform 12 rocks around the axis of shaft 30 as is depicted by directional arrow 60, FIG. 3.

In operation, the user places his feet in footholds 44 and 46 and grips handle 52 connected to rope 50. The user than shifts his weight from side to side from the position shown in FIG. 1 to cause a rocking motion of platform 12 according to directional arrow 60. At this point, wheel 32 moves according to directional arrows 40 and 42. Edge portion 20 of platform 12 will also rock on ground surface 18. Any excessive movement of wheel 32 will be stopped by means 54.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A toy for use on a surface comprising:

a. a platform having a first side and a second opposite side;

b. a post extending through said platform to said second side thereof, said post further including means for holding a portion of said post to said second side of said platform, said post being movable relative to said platform;

c. a turnable member, said turnable member bearing on said first side of said platform and being movable thereupon; said platform further contacting the surface;

d. an arm linked to said turnable member and post;

e. means for supporting the user on said second side of said platform.

2. The toy of claim 1 which additionally comprises stop means for preventing motion of said turnable member.

3. The toy of claim 2 in which said turnable member moves relative to said post.

4. The toy of claim 1 in which said platform includes an enlarged portion, said turnable member being movable along said enlarged portion of said platform.

* * * * *